United States Patent [19]

Manweiler

[11] 4,348,925

[45] Sep. 14, 1982

[54] CIRCULAR SAW SAFETY PUSHER DEVICE

[76] Inventor: Jack Manweiler, 1407 Laster Ave., Anaheim, Calif. 92802

[21] Appl. No.: 260,372

[22] Filed: May 4, 1981

[51] Int. Cl.[3] ..... B27B 25/10

[52] U.S. Cl. ..... 83/435.1; 144/25 R; 83/437; 83/707

[58] Field of Search ..... 83/435.1, 707, 425, 83/437, 401, 701; 144/251 R

[56] References Cited

U.S. PATENT DOCUMENTS 686,339 11/1901 Ritchie ..... 144/251 R

FOREIGN PATENT DOCUMENTS 4410 12/1919 Netherlands ..... 144/251 R

OTHER PUBLICATIONS

The Basic Book of Woodworking by P. E. Spielman, p. 103, FIG. 31–37.

*Primary Examiner*—Donald R. Schran

[57] ABSTRACT

A safety pusher device for use in guiding wooden work pieces through circular saws is provided which contains an L-shaped insert member containing an upper groove portion for slidable connection to a pusher handle. The insert member can be removed and replaced by another insert member upon being damaged and thus minimizes permanent damage to a pusher device.

1 Claim, 6 Drawing Figures

CIRCULAR SAW SAFETY PUSHER DEVICE

INTRODUCTION

The invention herein relates to a device for use in protecting a circular saw operator from harm while utilizing the saw for cutting of wood and the like.

Manual pressing and moving of wood over a table utilizing a circular saw and the like creates a substantial risk of harm to the operator in that while the operator pushes the wood through the circular saw, he or she is apt to cause contact with the circular saw and ultimate damage to the operator's hands. Pusher devices have been developed wherein the operator utilizes a wooden handle to literally push the wood or other work piece by the circular saw, thus minimizing potential contact and harm.

One problem with prior art pusher devices is that pusher devices themselves become damaged and replacement becomes frequent and expensive.

I have developed a pusher device wherein the contact element is replaceable, thus obviating the replacement of the entire pusher handle device.

Accordingly, one object of the invention is to provide a novel pusher device. Another object of the invention is to provide a pusher device wherein the contact element is replaceable. Other objects of the invention will be apparent from the following description.

DESCRIPTION OF THE INVENTION

In summary, the invention herein is an L-shaped insert member containing an upper extension portion internal with an L-shaped lower portion with one segment of the L being a block portion to be pressed on the edge of the wood, and the other L segment being a longer segment for placement on top of the wood. The L-shaped insert member is slidably connected to a pusher handle having a female groove for slidable connection of the upper groove portion of the L-shaped insert member.

Figure 1:
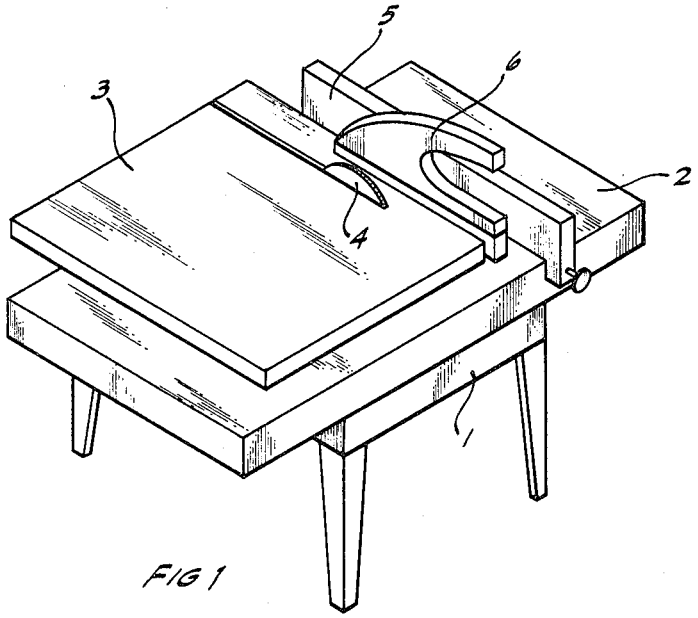
FIG. 1 shows a plan view of the invention illustrating a typical table, wood piece, circular saw and showing use of the novel pusher device described herein.

The invention is described in better detail with reference to the accompanying drawing. FIG. 1 shows a work table 1 containing a top 2 which contains and supports a wooden work piece 3, which is shown being cut by a circular saw 4. A typical and prior art guide 5 is placed on the work table top 2 to guide one edge of the wood piece 3. The pusher handle device 6 is shown for pushing wood piece 3 through the circular saw 4.

Figure 2:
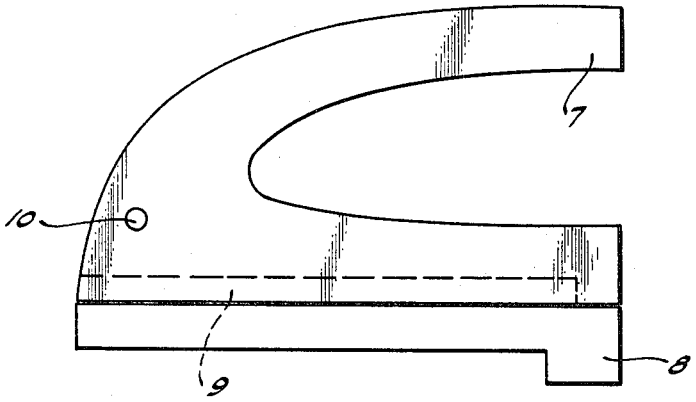
FIG. 2 is a side elevation view of the invention.

The pusher handle device 6 is shown in more detail in FIG. 2. The handle 7 is shown with the lower portion of the handle piece having an internal groove 9. Shown as Item 8 is the novel L-shaped insert member. The short member of the L is a block portion for placement on the edge of the wood, and the longer member is shown for placement on top of the wood.

Figure 4:
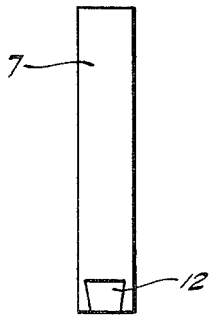
Figure 3:
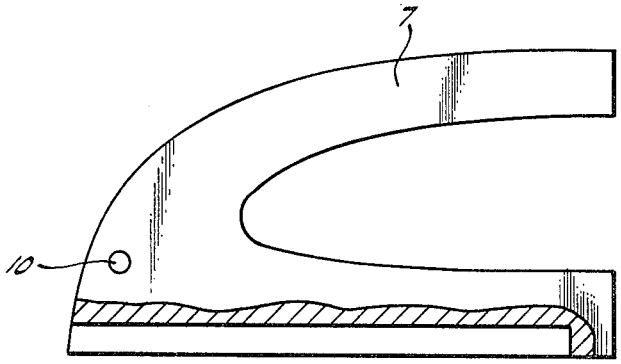
FIG. 3 is a side elevation view of the handle absent the added pusher element with FIG. 4 being an end view of the handle of FIG. 3.

FIG. 3 is a side view of the handle portion 7 absent the insert member 8 which is the novel feature of this invention. FIG. 4 is an end view of the handle portion 7. There is shown in FIG. 4 a channel area 12.

Figure 6:
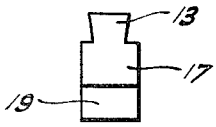
Figure 5:
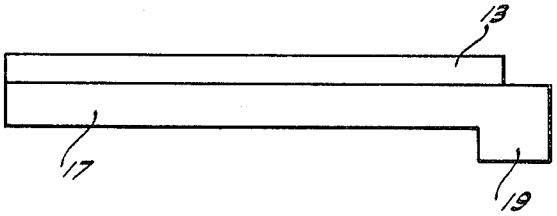
FIG. 5 is a side elevation view of the added insert member with FIG. 6 being an end view of the element of FIG. 5.

FIG. 5 shows the L-shaped insert member 8 which contains a short end block portion 19 and the longer segment 17. As stated above, block portion 19 is placed along the edge of the wood with the operator utilizing the inner edge of portion 19 to push the wood, and the longer segment member 19 is placed along the top of the wood. Along the top of segment 17 is upper male extension 13 which is also shown in FIG. 6, and is simply a part that slidably fits within channel 12 of the handle and enables insert element 17 to be removably connected to a prior art pusher which contains a groove portion.

In operation, one slides the novel insert member in the handle pusher device and utilizes the combination for standard pushing operation of a wood piece or other such work piece to be cut by a circular saw. In the event that damage is done to the pusher, the insert member is simply discarded and replaced by a new insert member to the same pusher device, thus eliminating the necessity of replacement of the more expensive pusher device.

I claim:

1. A safety pusher device to aid in the cutting of wood pieces by a circular saw comprising:

(a) an elongated pusher handle member;

(b) an elongated insert member;

(c) said elongated pusher handle member having an upper gripping portion and a lower body portion provided with a channel along its lower portion;

(d) said elongated insert member having an extension portion along its upper portion shaped to conform to channel in said body portion of said pusher handle member and slidably received in said channel of said pusher handle member; and (e) said insert member is L-shaped comprising an elongated body supporting said extension portion and depending a block portion so that said block portion contacts and pushes a wood piece to be cut by said circular saw.

* * * * *